US006324733B1

(12) United States Patent
Brown

(10) Patent No.: US 6,324,733 B1
(45) Date of Patent: Dec. 4, 2001

(54) ADJUSTABLE, QUICK RELEASE CLASP

(76) Inventor: Ryan L. Brown, 7340 Fox Hollow Ridge, Zionsville, IN (US) 46077

( * ) Notice: Subject to any disclaimer, the term of this patent is extended or adjusted under 35 U.S.C. 154(b) by 0 days.

(21) Appl. No.: 09/448,960

(22) Filed: Nov. 24, 1999

(51) Int. Cl.[7] ..... A44B 17/00

(52) U.S. Cl. ..... 24/580; 292/15; 16/86 A

(58) Field of Search ..... 24/265 WS, 265 EC, 24/265 BC, 580, 582, 583, 584, 585, 460, 350, 313, 336, 341, 325, 171, 181, 645, 631, 664, 662, 629, 666, 652; 292/9, 15, 23; 16/86 A, 86 B, 85

(56) References Cited

U.S. PATENT DOCUMENTS

| | | | | |
|---|---|---|---|---|
| 2,502,607 | * | 4/1950 | Vinton | 292/23 |
| 2,659,620 | * | 11/1953 | Ter Meer | 292/15 |
| 2,749,163 | * | 6/1956 | Loeb | 292/15 X |
| 2,837,361 | * | 6/1958 | Loeb | 292/15 |
| 3,786,218 | | 1/1974 | Fisher . | |
| 3,814,491 | | 6/1974 | Kackley . | |
| 3,815,944 | | 6/1974 | Noga . | |
| 3,857,594 | | 12/1974 | Pastva, Jr. . | |
| 3,904,230 | | 9/1975 | Fane et al. . | |
| 3,929,360 | | 12/1975 | Gulistan . | |
| 4,023,240 | | 5/1977 | Rieth . | |
| 4,154,428 | | 5/1979 | Merry . | |
| 4,296,533 | | 10/1981 | Doerter . | |
| 4,361,939 | * | 12/1982 | Gelula et al. | 24/645 |
| 4,435,027 | | 3/1984 | Prather et al. . | |
| 4,477,949 | | 10/1984 | Calabro . | |
| 4,505,008 | | 3/1985 | Yoshikawa . | |
| 4,533,894 | | 8/1985 | Bishop et al. . | |
| 4,604,772 | | 8/1986 | Arff . | |
| 4,630,815 | | 12/1986 | Petersen et al. . | |
| 4,642,855 | | 2/1987 | Densmore . | |
| 4,677,714 | | 7/1987 | Wright . | |
| 4,907,469 | | 3/1990 | Gobbi . | |
| 4,937,923 | | 7/1990 | McEntire . | |
| 4,945,616 | | 8/1990 | Okano . | |
| 4,957,334 | | 9/1990 | Lakso . | |
| 4,978,152 | | 12/1990 | Bisbing . | |
| 5,165,629 | | 11/1992 | Breveglieri . | |
| 5,203,620 | | 4/1993 | McLennan . | |
| 5,205,021 | | 4/1993 | Durand . | |
| 5,226,719 | | 7/1993 | Feldpausch et al. . | |
| 5,309,610 | | 5/1994 | LeGal . | |
| 5,573,362 | | 11/1996 | Asami et al. . | |

(List continued on next page.)

OTHER PUBLICATIONS

Description of two belts (with drawings) based upon personal observation of the inventor. No date given.

*Primary Examiner*—Robert J. Sandy
(74) *Attorney, Agent, or Firm*—Baker & Daniels

(57) ABSTRACT

A clasp includes a keeper assembly to one end of a belt or strap or the like and an engaging member attached to the other end of the belt or strap. The keeper includes a pair of arms having at least two retaining members mounted thereon. At least one of the retaining members is movably mounted on the arms. One or more springs are positioned so that they operate on the retaining members biasing them against each other. In another embodiment, the keeper assembly includes a housing having a channel for receiving the retaining members. In preferred embodiments, the engaging member includes a locking tab that is disposable between two of the retaining members to engage the engaging member to the keeper. In preferred embodiments, the locking tab has an enlarged tip and is recessed on its sides according to the contour of the retaining members. These two features, together with the action of the springs or biasing members, cooperate to secure the engaging member to the keeper assembly. Disengagement is accomplished by lifting the free end of the engaged member up and away from the keeper assembly using the finger of one hand.

15 Claims, 5 Drawing Sheets

U.S. PATENT DOCUMENTS

| | | |
|---|---|---|
| 5,579,563 | 12/1996 | Sim . |
| 5,593,192 | 1/1997 | Stuchinsky . |
| 5,671,515 | 9/1997 | Evans . |
| 5,743,606 | 4/1998 | Scholder . |
| 5,774,952 | 7/1998 | Ito . |
| 5,784,758 | 7/1998 | Carrick . |
| 5,797,714 | 8/1998 | Oddenino . |
| 5,832,573 | 11/1998 | Howell . |
| 5,836,903 | 11/1998 | Peters . |

* cited by examiner

ADJUSTABLE, QUICK RELEASE CLASP

FIELD OF THE INVENTION

The present invention relates to an adjustable, quick release clasp suitable for use with belts, garments, portfolios, purses or any apparatus for the retention of objects or closure of containers. The invention is particularly directed to a buckle that can be easily manipulated by persons with impaired or reduced manual dexterity.

BACKGROUND OF THE INVENTION

Prior buckles can be largely classified into two major categories. The first is typified by the invention of U.S. Pat. No. 4,991,272 to Bianchi, which discloses a buckle comprising male and female members. The female member forms a receptacle into which the male member is inserted. The male member has a pair of locking lugs at the end of flexible arms which protrude through openings in the female member. Engagement usually requires the use of both hands of the operator; and, release requires the use of at least two fingers to simultaneously depress the locking lugs. U.S. Pat. No. 5,438,737 to Ansher, which discloses a snap closure with quick release, represents an improvement over this type of buckle through its adaptation for release by pressure from a single finger of the operator. To facilitate ease of use a thinner and thus more flexible male member can be used, however, this introduces weakness into the buckle and reduces the security of the engagement of the buckle components.

The second major category is exemplified by buckles of the type shown in U.S. Pat. No. 5,860,199 to Liu, which discloses a, quick release belt buckle. Engagement involves the insertion of a plug member into a body member, which generally requires the use of both hands of the operator. Release is achieved by pressing a spring loaded button that extends through the top cover plate of the body. This buckle can be made of metal for added strength and durability, however it requires dexterity to operate.

A need remains for a fastener readily usable by persons with limited dexterity due to disability, disease, injury, youth, or advanced age. Such persons often find it difficult or painful to manipulate a buckle requiring the use of both hands to align and insert one component into another to achieve engagement without the assistance of another person. The simultaneous compression of locking lugs to release a buckle can be equally cumbersome and/or painful for persons having these conditions. Accordingly, a primary object of the present invention is to provide an improved clasp or buckle that can be easily operated by persons with impaired manual dexterity yet provides a secure engagement. The present invention thus provides a greater level of independence for people who might otherwise require assistance to perform basic, day-to-day activities, such as dressing themselves.

BRIEF SUMMARY OF THE INVENTION

The present invention provides an adjustable, quick release clasp for clothing and other objects that can be adjustably engaged and released with one hand requiring only pushing and lifting motions. In one embodiment, an engaging member is attached to one end of a belt, for instance, and includes a locking tab, which is pushed into a keeper. The keeper has a number of movable retaining members and is attached to the other end of the belt. The retaining members are slidably mounted on a pair of arms.

The arms have a shoulder at one end to limit the movement of the retaining members. A connector member connects the other ends of the arms and provide a point of attachment for the other end of the belt.

In one embodiment, the keeper assembly also includes a means for biasing the retaining members together. The biasing means can take the form of either compression springs, tension springs, elastic bands, or the like, suitably operating on the retaining members to push them together. To engage the clasp, the locking tab is inserted between two adjacent retaining members against the force of the biasing means. Preferably, the locking tab is recessed on its sides to match the contour of the retaining members. The recesses on the locking tab, along with an enlarged tip at the end of the locking tab and the action of the biasing means, cooperates with the retaining members to securely hold the engaging member within the keeper assembly. The tip of the locking tab is also preferably chamfered to reduce the force required for insertion into the keeper assembly.

Release is accomplished by lifting upward on the free end of the engaged member. The force required for closure and release can be adjusted for the particular application by selection of springs of appropriate strength or stiffness for the biasing means and by the contour of the retaining members and the locking tab recesses. The invention can be made from a variety of materials from metal to hard plastic and thus provides a broad range of application.

In an alternate embodiment, the keeper comprises a housing containing a channel into which the retaining members and biasing spring members are placed. In operation, the retaining members may either roll or slide within the housing to accommodate and grip the locking tab of the engaged member. The action is dependent upon the geometry selected for the retaining members. If rolling is desired, a cylindrical geometry would be preferred. This embodiment offers the advantage of having the biasing means enclosed within the housing so as to avoid interference with clothing or the article being fastened.

In a third embodiment similar to the first, the keeper includes a fixed retaining member from which a pair of arms extend. One or more movable retaining members are attached to the arms followed by the biasing means and a bar which connects the other ends of the arms and which includes a means for attachment of a belt. In other respects, operation of the clasp is the same as previously described. Both this embodiment as well as the first can incorporate the housing of the second embodiment to conceal the biasing means and arms should that be considered advantageous.

One primary object of this invention is to provide an improved clasp or buckle which combines strength and durability with simplicity and ease of use in one buckle design. The clasp of the present invention accomplishes this objective. The invention is particularly suited for use by children or by persons with limited strength or dexterity due to injuries, disease or disability. Engagement of the clasp requires only that the engaging member be placed in a position overlapping the keeper assembly followed by pushing the two components together forcing the locking tab between two adjacent retaining members of the keeper assembly. Little precision or coordination is required. With similar ease, the clasp is disengaged by simply lifting the free end of the engaged member up and away from the keeper assembly using the finger of one hand. These features provide a differently abled person a degree of independence and self sufficiency.

These and other objects, advantages, and features are accomplished according to the devices of the following descriptions of the preferred embodiments of the present invention.

DESCRIPTION OF THE PREFERRED EMBODIMENTS

Figure 3:
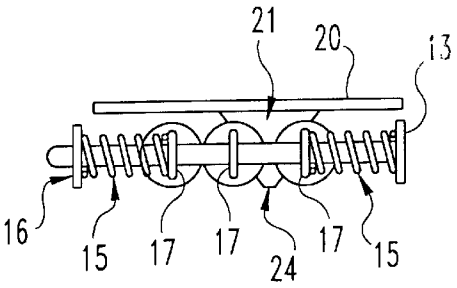
FIG. 3 is a top elevational view of one embodiment of the clasp with the keeper assembly of FIG. 1 engaged to the engaging member of FIG. 2.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an adjustable, quick release clasp that is easy to use and which is adaptable to many applications through the selection of components and materials of construction. This clasp is particularly suited for use by children or by persons with limited strength or dexterity. The clasp can be used to attach or mount one object to another or can be used as a latching mechanism. In the preferred embodiments that follow, the clasp is used as a buckle to fasten the ends of a belt or strap together.

Figure 1:
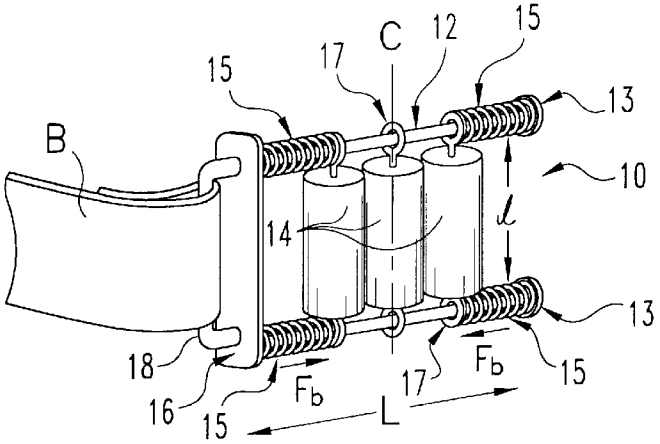
FIG. 1 is a perspective view of one embodiment of the keeper assembly with the fragmentary end of a belt.
Figure 2:
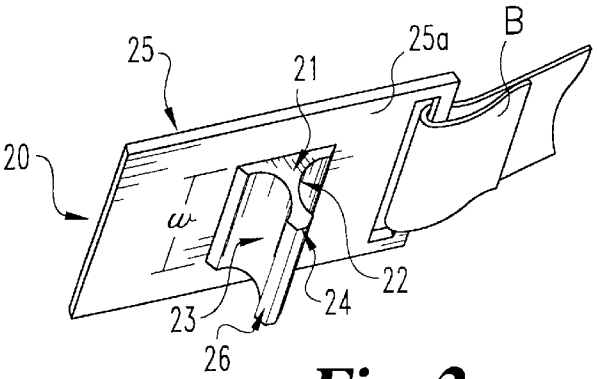
FIG. 2 is a perspective view of the engaging member engageable to the keeper assembly of FIG. 1 with the fragmentary end of a belt attached thereto.

Referring to the drawings, a clasp in accordance with one embodiment of the invention is illustrated in FIGS. 1–2. The clasp includes a keeper 10 and an engaging member 20. In this embodiment, the keeper includes three retaining members 14 mounted on a pair of parallel arms 12 using rings 17. Preferably, a ring 17 is formed at one end of a rod that extends through the length l of the retaining member 14 and culminates in a second ring 17 at the other end of the retaining member. The retaining members 14 are slidable or movable along the length L of the arms 12 as the rings 17 slide along the arms.

In one embodiment, a shoulder 13 is provided at one end of each arm to act as a stop member. A connecting member such as bar 16 preferably connects the opposite ends of the arms 12 for stabilizing the keeper. One suitable means of connecting bar 16 to the arms 12 is by screws. The bar 16 also includes a means 18 for connecting a belt B or strap making the clasp usable as a buckle. This means 18 can include a bar, for instance, about which one end of the belt B can be connected.

The keeper assembly further includes a biasing member or means for biasing the retaining members together. In one embodiment, the biasing means includes a set of compression springs 15 concentrically mounted at the inboard and outboard ends of the arms 12. As shown in FIG. 1, the springs 15, under compression, act against the shoulders 13 and rings 17 at one end of the arms 12 and against the bar 16 and rings 17 at the other end of the arms 12 thus pushing all the retaining members 14 toward the centerline C of the keeper 10 and against each other. Through this action, the springs provide a force sufficient to secure or hold the engaging member 20 within the keeper 10.

Turning now to FIG. 2, the engaging member 20 preferably includes a plate member 25 having a locking tab 21 integrally projecting from the underside 25*a* of plate member 25. The locking tab 21 is preferably centrally positioned and extends down from and perpendicular to the underside 25*a* of the plate 25. The opposite or top side (not shown) of the plate member 25 preferably provides a decorative presentation. The width W of the locking tab 21 is preferably slightly less than the length l of the retaining members 14 (see FIG. 1). The length of the locking tab 21, i.e. its projection away from the plate 25, is generally greater than the diameter or height of the retaining members 14 to provide secure engagement. Locking tab 21 preferably includes an enlarged tip 24 and is contoured with recesses 22 and 23 on its sides. Preferably, the recesses 22 and 23 generally approximate the shape of the periphery of the retaining members 14 as shown in FIG. 1 to form a seat for receiving the retaining members 14, when locking tab 21 is positioned between retaining members 14.

Referring again to FIG. 1, enlarged tip 24 and side recesses 22 and 23 cooperate with the retaining members 14 under influence from springs 15 to secure the locking tab 21 and thus hold the engaged member 20 within the keeper assembly 10. Engagement of the clasp is accomplished by pushing the locking tab 11 of the engaging member between and through adjacent retaining members 14 against the bias force $F_b$ of the springs 15 as shown in FIG. 3. The enlarged tip 24 of locking tab 21 preferably has a chamfered surface 26 for ease of insertion into the keeper 10.

Figure 3A:
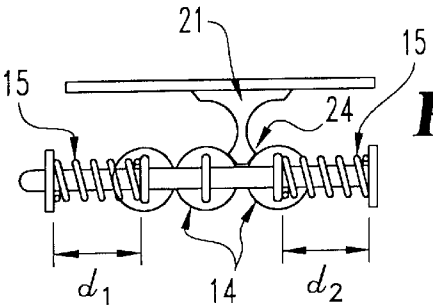
FIGS. 3A–3B top elevational views of the embodiment of FIG. 3 showing the keeper assembly and engaging member in progressive stages of engagement.
Figure 3B:
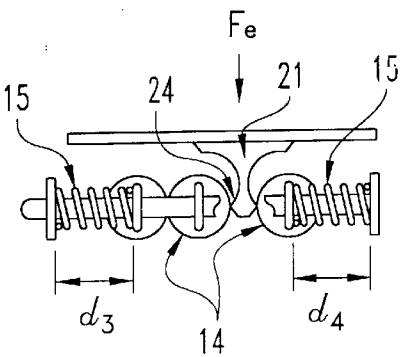

FIGS. 3A and 3B depict two stages in the engagement process. In FIG. 3A, locking tab 21 is positioned between two adjacent retaining members 14. At this stage, springs 15 are shown having lengths dl and d2. Application of an engagement force $F_e$ to the engaging member 20 results in the stage shown in FIG. 3B. Here, as the enlarged tip 24 passes by the retaining members 14, the springs 15 are further compressed to lengths d3 and d4, which are less the dl and d2 respectively. Continued pressure results in the engaged condition of FIG. 3 as the tip 24 moves past the retaining members 14.

FIGS. 3, 3A, and 3B illustrate the ease of use feature of the invention. Engagement only requires that the locking tab 21 be positioned approximately between adjacent retaining members and then pushed. If the locking tab 21 is slightly off center, it will slide into position upon receiving the engagement force $F_e$. An additional benefit of the invention is also revealed in that the use of multiple retaining members 14 provides the capability for adjustment of the length of the belt. In other words, the locking tab 21 can be inserted between the first and second retaining members 14, between the second and third retaining members 14, and so on when three or more retaining members are provided.

Figure 5:
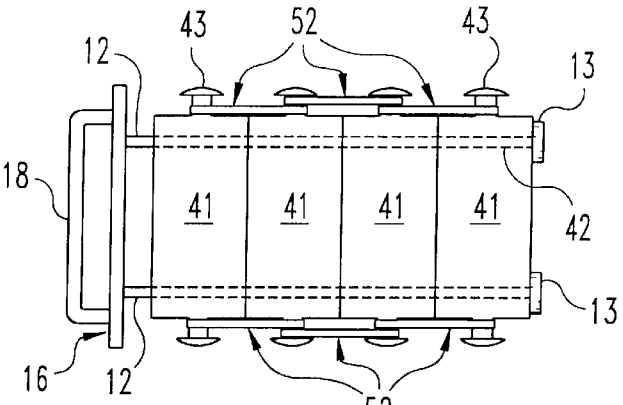
FIG. 5 is a front elevational view of a keeper assembly according to another embodiment of the invention with an alternative biasing means.
Figure 4:
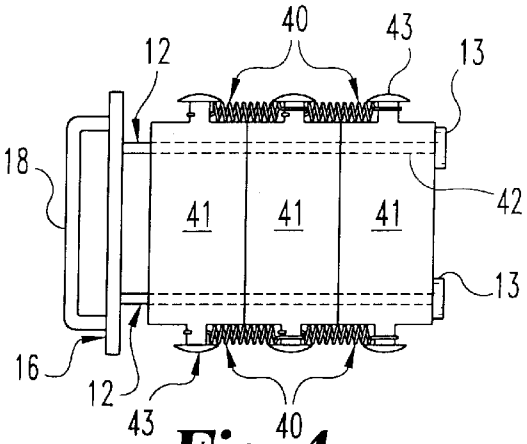
FIG. 4 is a front elevational view of a keeper assembly according to another embodiment of the invention with an alternative biasing means.

Any suitable bias members are contemplated. For example, tension members depicted in FIGS. 4–5 can be substituted for the compression springs 15 of the embodiment in FIG. 1. FIG. 4 shows a set of retaining members 41 interconnected with tension members in the form of tension springs 40 such that the retaining members 41 are biased against each other. As shown in FIG. 5, the tension members can be a number of elastic bands 52. FIG. 5 also illustrates the addition of a fourth retaining member, which provides an additional engagement location. Other means for accomplishing the function of biasing the retaining members together may also exist.

The stiffness of the springs or bands may be varied to adjust the closing and retention forces to suit the particular application. Springs of greater stiffness can be used in applications where the clasp may be under greater tension or load, such as when binding things together. A lesser spring force may be acceptable, for instance, when used with a clothing accessory belt.

FIGS. 4 and 5 also show an alternative means for mounting the retaining members and biasing means. The retaining members 41 are shown having a transverse hole 42 at each end through which the arms 12 traverse such that the retaining members 41 slide directly on the arms 12. In addition, the retaining members 41 are shown with a stud 43 projecting from each end for attachment of the biasing means.

Figure 7:
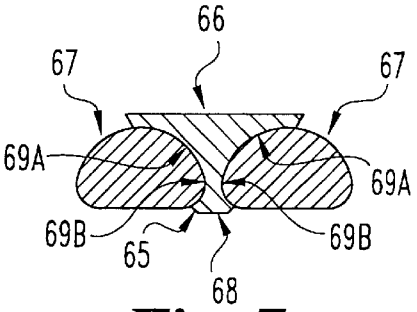
FIG. 7 is a top cross-sectional view illustrating alternative retaining member and locking tab geometries.
Figure 6:
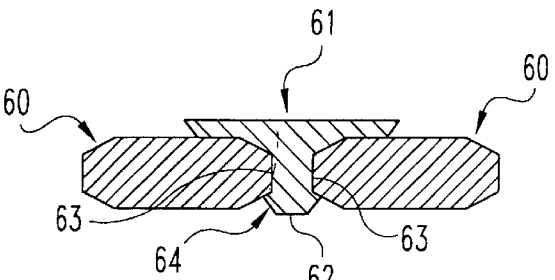
FIG. 6 is a top cross-sectional view illustrating alternative retaining member and locking tab geometries.

Turning now to FIGS. 6–7, shown are cross sectional views of adjacent retaining members with an engaged locking tab. Whereas FIG. 1 shows retaining members 14 having a cylindrical cross section, FIGS. 6 and 7, illustrate that other geometries for the retaining member, 60 in FIG. 6 and 67 in FIG. 7 and correspondingly for the locking tab, 61 in FIG. 6 and 66 in FIG. 7 may be selected. Note that the enlarged tip feature 62 and 68 and chamfering of the locking tab 64 and 65 are preferably retained.

The selection of retaining member geometry is another factor which influences the retention force and the engagement and releasing forces. The retaining member and locking tab configuration of FIG. 6 would provide a very secure closure of the clasp accompanied by increased effort required to close and release the clasp. This design may also require the use of harder materials finished to reduce surface friction to reduce wear in use. The configuration of FIG. 7 shows retaining members and locking tab having asymmetrical contours. The contour of the retaining member in the area of locking tab entry 69A is shown having a larger radius or gradual curvature. By comparison, the retaining member contour at 69B is of a shorter radius or sharper curvature. The gradual curvature 69A in the area of locking tab entry allows ease of closure while the sharper curvature 69B in the area shown results in greater retention force and require more force to release.

Figure 9:
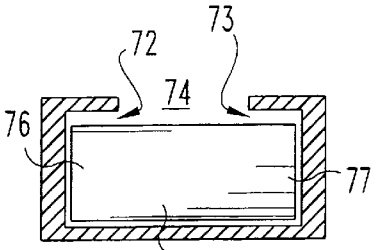
FIG. 9 is a sectional view of the keeper assembly of FIG. 8 taken along lines 9—9.
Figure 10:
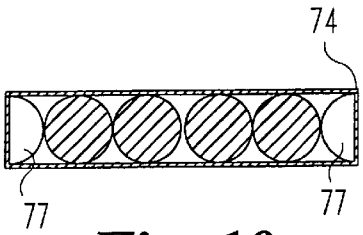
FIG. 10 is another sectional view of the keeper assembly of FIG. 8 taken along lines 10—10.
Figure 8:
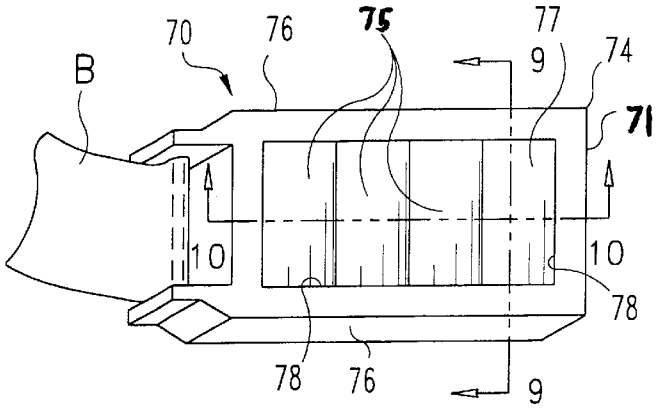
FIG. 8 is a front elevational view of a further embodiment of the keeper assembly with the fragmentary end of a belt.
Figure 11:
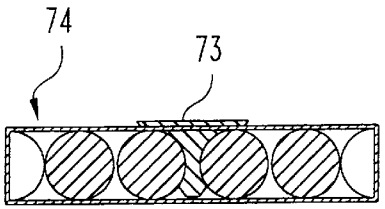
FIG. 11 is a top cross-sectional view of the keeper assembly of FIG. 8 with the locking tab engaged.

Another embodiment of the invention is shown in FIGS. 8–10. In this embodiment, the keeper 70 includes a housing 71 defining a first channel 72 and an opposite second channel 73 parallel to the first channel 72. The housing 71 defines a center opening 74 between the channels 72, 73. The first end 76 of each retaining member 75 is movably disposed within the first channel 72 and the second end 76 is disposed within the second channel 73. Biasing means, which in this embodiment can include a pair of leaf springs 77 positioned at the ends of the housing 74, operate on the retaining members to bias them together. The retaining members, if cylindrical, may either roll or slide within the housing. Other geometries for the retaining members will be restricted to a sliding motion. It should be noted, of course, that any suitable biasing means is contemplated for this invention. For example, the compression springs, tension springs, or elastic bands previously discussed may be adapted for use with this embodiment. This embodiment offers the advantage of having the biasing means enclosed within the housing so as to avoid interference with clothing or the article being fastened. Insertion of the locking tab of the engaging member is accomplished through the center opening 74 in the top of the housing as depicted in FIG. 11.

Figure 12:
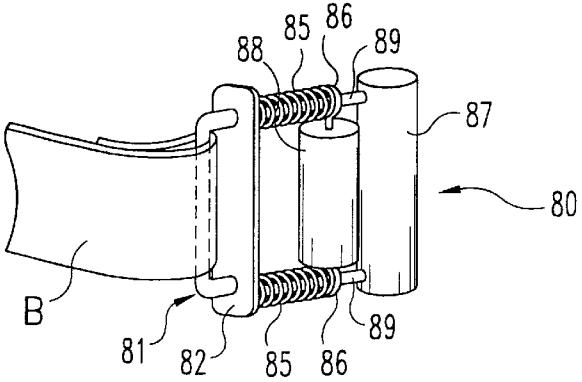
FIG. 12 is a front elevational view of a third embodiment of the keeper assembly with the fragmentary end of a belt.

Yet another embodiment of a keeper is shown in FIG. 12. The keeper 80 illustrated includes one retaining member 87 fixed to a pair of arms 89 such as by threading the arms into the retaining member. A second retaining member 88 is slidably mounted on the arms by, for instance, a ring 86 attached to each end of the retaining member 88 through which the arms 89 extend. A connector bar 82 having a means 81 for attaching a belt is connected to the other ends of the arms. A biasing means 85 can include compression springs, for instance, interposed between the movable retaining member 88 and the bar 82 to force the retaining members together. Engagement of the clasp is accomplished in a similar fashion to the embodiments previously discussed by forcing the locking tab of the engaging member between the retaining members.

Figure 13:
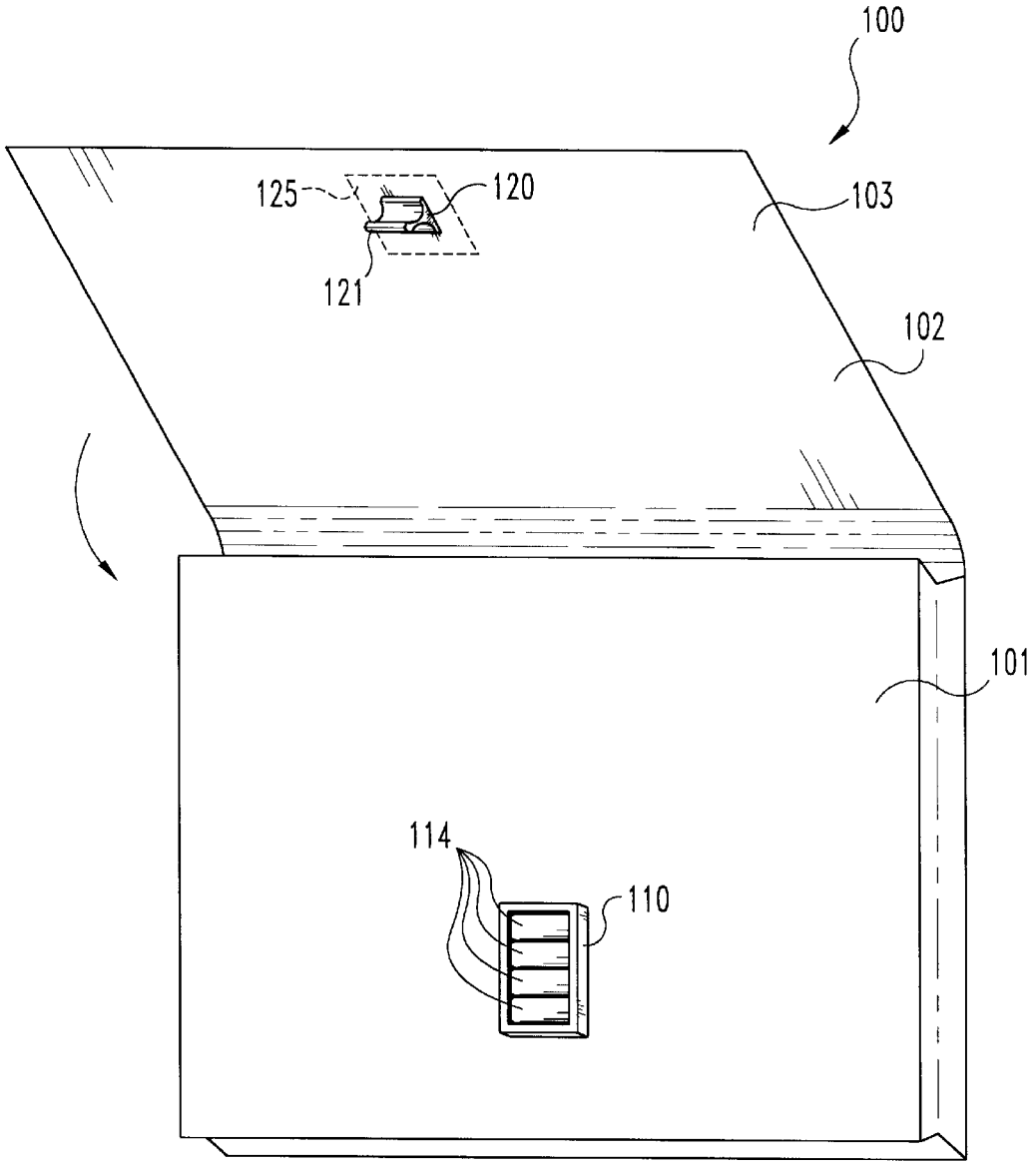
FIG. 13 is a perspective view of another embodiment of this invention.

The present invention is also useful for items such as the portfolio 100 depicted in FIG. 13. The portfolio 100 includes a container 101 for carrying items such as papers and a closure flap 102. This particular embodiment includes a fastener assembly similar to the one shown in FIGS. 8–10. A keeper 110 is provided on the container 101. The keeper 110 may be sewn into, affixed onto or otherwise attached to the container by any suitable means. An engaging member 120 is attached to the inner surface 103 of flap 102. The engaging member 120 is attached to the flap 102 using any suitable means. In this embodiment, the plate member 125 of engaging member 120 is sandwiched between layers of the flap material. The locking tab 121 of engaging member 120 can be positioned between any two retaining members 114 for adjustable closure. Although the present invention is described in use with belts and portfolios, it will be appreciated that the present invention is useful with any item that requires a fastener.

Figure 14A:
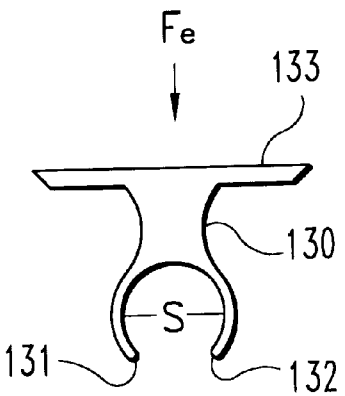
FIGS. 14A–D are front elevational views of other embodiments of the locking tab.

The present invention also contemplates other means for engaging the keeper to the engaging member. The locking tab of the engaging member can be configured in any suitable member that will provide engagement of the engaging member to the keeper. Examples of suitably configured locking tabs are shown in FIGS. 14A–D. In FIG. 14A, the locking tab 130 has a pair of flexible tongs 131, 132 shaped to receive a retaining member. For example, the retaining member may have a circular cross section as shown in FIG. 1 to be received within the circular space S between tongs 131, 132. For engagement, the locking tab 130 is positioned over the retaining member and an engaging force $F_e$ is applied to the plate member 133. As the engaging force is applied, the tongs 131, 132 are deformed to receive the retaining member. Once the retaining member is received within the space S, the tongs preferably resume to their undeformed state with the retaining member grasped by the tongs 131, 132 until a disengagement force is applied.

Figure 14B:
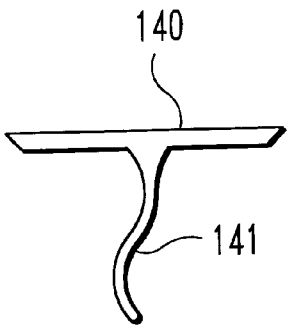
Figure 14C:
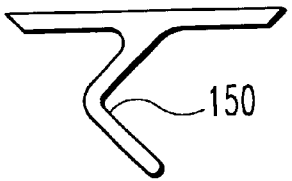
Figure 14D:
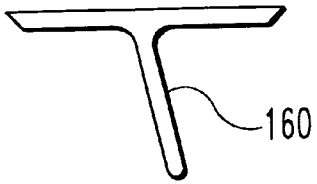

The embodiments shown in FIGS. 14B–D are configured to be forced between retaining members against the force of the biasing means. The locking tab 140 shown in FIG. 14B has a curved portion 141 that is shaped to receive a curved retaining member while the locking tab 150 shown in FIG. 14C has an angled construction for engaging retaining members. As shown in FIG. 14D, the locking tab 160 may be shaped as a post type member of any thickness. Preferably, the locking tab 160 will not be perpendicular to the plate member for better engagement between engagement members.

The clasps described herein may be constructed from a variety of materials. Best results will be achieved by the use of a hard material such as metal or hard plastic. Metal is most preferable for the retaining members and locking tab. The material surface should have coefficient of friction characteristics similar to that of a smooth ferrous metal and being resistant to wear and galling.

While the invention has been described with a certain degree of particularity, it is apparent that variations and modifications can be made with the attainment of all the advantages of the invention without departing from the spirit and scope of the invention disclosed. It is understood that the invention is not limited to the embodiments set fourth herein for purposes of exemplification, but is to be limited only by the scope of the attached claims, including the full range of equivalency to which each element thereof is entitled.

What is claimed is:

1. A clasp, comprising:

a keeper including:

a pair of parallel, elongated arms, each said arm having inboard and outboard ends, at least two retaining members slidably mounted on said arms, means for biasing said retaining members against each other, and a connecting member connecting the inboard end of said pair of arms, and an engaging member including a plate member having a locking tab projecting therefrom and disposable between two of said retaining members, said locking tab configured for insertion and retention between adjacent ones of said retaining members.

2. The clasp of claim 1 further comprising an enlarged tip extending from said locking tab.

3. The clasp of claim 2 wherein said enlarged tip of said locking tab is chamfered for ease of insertion between said retaining members.

4. The clasp of claim 2 wherein said locking tab defines opposite sides contoured to form recesses for receiving adjacent retaining members therein, whereby said recesses and said enlarged tip of the locking tab cooperate to secure the locking tab between the retaining members.

5. The clasp of claim 4 wherein said retaining members are substantially cylindrical in shape and the contour of said locking tab recesses is circular in shape.

6. The clasp of claim 4 wherein said retaining members are noncircular in cross-section and the contour of said locking tab recesses is noncircular in shape.

7. The clasp of claim 1 wherein said elongated arms have a shoulder at the outboard end to limit movement of said retaining members along said arms.

8. The clasp of claim 1 wherein said means for biasing said retaining members against each other includes a number of tension members connected between said retaining members to urge said retaining members against each other.

9. The clasp of claim 1 wherein said retaining members include a rod extending through the length of said retaining member and culminating in a ring at each end for slidably mounting said retaining members on said arms.

10. The clasp of claim 1 wherein said retaining members have a transverse hole adjacent each end for slidably mounting said retaining members on said arms.

11. The clasp of claim 1 wherein at least one of said keeper or engaging member has means for attachment to a strap.

12. The clasp of claim 1 wherein said means for biasing the retaining members against each other includes a number of compression springs on at least one end of said arms operating against at least one of said retaining members to urge said retaining members against each other.

13. A clasp comprising:

a keeper including a pair of parallel, elongated arms each having inboard and outboard ends, a fixed retaining member fixedly attached to the outboard end of said arms, at least one additional retaining member slidably mounted on said arms, means for biasing said at least one additional retaining member against said fixed retaining member, and a connector member connected to said inboard end of each of said arms; and an engaging member including a plate member having a locking tab projecting therefrom, said locking tab configured for insertion and retention between adjacent ones of said retaining members.

14. A clasp comprising:

a keeper including a housing, said housing having a first channel, an opposite second channel parallel to said first channel and an opening defined between said first and second channels, at least three retaining members, each retaining member having first and second ends, said first end of each retaining member disposed within said first channel and said second end of each retaining member disposed within said second channel with a middle portion of each said retaining member spanning said opening, means for biasing said retaining members against each other; and an engaging member including a plate member having a locking tab therefrom, said locking tab disposable between two of said retaining members to engage said engaging member to said keeper.

15. A clasp comprising:

a keeper assembly including a first elongated arm and a second elongated arm parallel to said first elongated arm, each said elongated arm having an inboard end and an outboard end, a connector member connected to said inboard end of both of said elongated arms, a number of retaining members slidingly mounted on said elongated arms, and a biasing member disposed on at least one of said inboard end and said outboard end of both of said elongated arms, said biasing member pushing one of said retaining members into contact with another of said retaining members; and an engaging member including a locking tab disposable between two of said retaining members to engage said engaging member to said keeper.

* * * * *